United States Patent [19]

Brimhall et al.

[11] Patent Number: 4,738,655

[45] Date of Patent: Apr. 19, 1988

[54] APPARATUS AND METHOD FOR OBTAINING A RAPID HEMATOCRIT

[75] Inventors: Owen D. Brimhall, West Valley City; Thomas J. McLaughlin, Salt Lake City; Charles D. Baker, Sandy; Stephen C. Peterson, Salt Lake City, all of Utah

[73] Assignee: Utah Bioresearch, Inc., Salt Lake City, Utah

[21] Appl. No.: 63,488

[22] Filed: Jun. 17, 1987

[51] Int. Cl.[4] ..... B04B 9/04

[52] U.S. Cl. ..... 494/10; 494/16; 494/37; 494/84

[58] Field of Search ..... 494/10, 11, 16, 20, 494/37, 43, 46, 83, 84, 85; 210/781, 782

[56] References Cited

U.S. PATENT DOCUMENTS 3,233,825 2/1966 Lomb ..... 494/84
3,567,113 3/1971 Stansell ..... 494/84
4,221,325 9/1980 Kubota ..... 494/16
4,226,669 10/1980 Vilardi ..... 494/16

*Primary Examiner*—Robert W. Jenkins
*Attorney, Agent, or Firm*—J. Winslow Young

[57] ABSTRACT

A hand-held centrifuge apparatus for sedimenting a fluid suspension in a sample tube, the sample tube being subjected to centrifugation at an acute angle to the axis of rotation. An electronic circuit activates an electric motor for a preselected time period as a function of voltage supplied by a battery to the motor to provide a predetermined degree of centrifugation to the sample. A voltage tester periodically tests the voltage in the circuit to assure that adequate voltage is being supplied by the battery. A deactivation circuit is actuated if inadequate voltage is sensed and a disabling circuit disables the electronic circuit until adequate voltage is again available. The disabling circuit is masked during acceleration to preclude deactivating the circuit when the motor is in acceleration.

16 Claims, 8 Drawing Sheets

APPARATUS AND METHOD FOR OBTAINING A RAPID HEMATOCRIT

BACKGROUND

1. Field of the Invention

This invention relates to hematocrit apparatus and methods and, more particularly to hematocrit apparatus and methods for obtaining a rapid hematocrit.

2. The Prior Art

Hematocrit determinations are used extensively within the field of medicine and involve obtaining a small sample of blood from a patient. The blood sample is drawn into a tube, known as the hematocrit tube, and the tube is then placed in a centrifuge apparatus where the blood sample is subjected to very high acceleration forces to cause the blood cells to be packed into the bottom of the tube. At the end of centrifugation the hematocrit tube is examined and the ratio of serum above the packed cell volume (PCV) is compared with standard charts to give to the medical personnel the desired information regarding the blood sample.

Due to the size, complexity, and cost of the conventional centrifugation apparatus it is usually found in a central laboratory location. This means that there is a significant time delay between the withdrawal of the blood sample and the availability of the hematocrit reading. Further, this means that the ability to obtain the hematocrit reading by emergency personnel at an accident scene or in an ambulance is not possible or, at best, not practicable.

It would, therefore, be an advancement in the art to provide a portable hematocrit centrifuge that can be hand held, if necessary. It would be a further advancement in the art to provide a method for obtaining hematocrit readings relatively rapidly. Such a novel apparatus and method is disclosed and claimed herein.

BRIEF SUMMARY AND OBJECTS OF THE INVENTION

This invention relates to a novel apparatus and method for obtaining hematocrit readings at remote locations and within a relatively short time period. A hand-held centrifuge apparatus having a rotor head in which the hematocrit tube is held at an acute angle to the axis of rotation supplies the necessary separation in the hematocrit tube. A battery system through an electrical circuitry drives the electric motor to turn the rotor head at the preselected rotational speed and for the predetermined rotational speed and for the predetermined time. A signal system provides an indication when the centrifugation cycle has been completed.

It is, therefore, a primary object of this invention to provide improvements in the method for obtaining hematocrit readings.

Another object of this invention is to provide a hand-held centrifuge apparatus for providing hematocrit readings at remote locations.

Another object of this invention is to provide a relatively rapid method for obtaining hematocrit readings.

Another object of this invention is to provide a method for obtaining hematocrit readings at remote locations.

These and other objects and features of the invention will become more readily apparent from the following description and accompanying drawing taken in conjunction with the appended claims:

DETAILED DESCRIPTION OF THE PREFERRED EMBODIMENT

Figure 1:
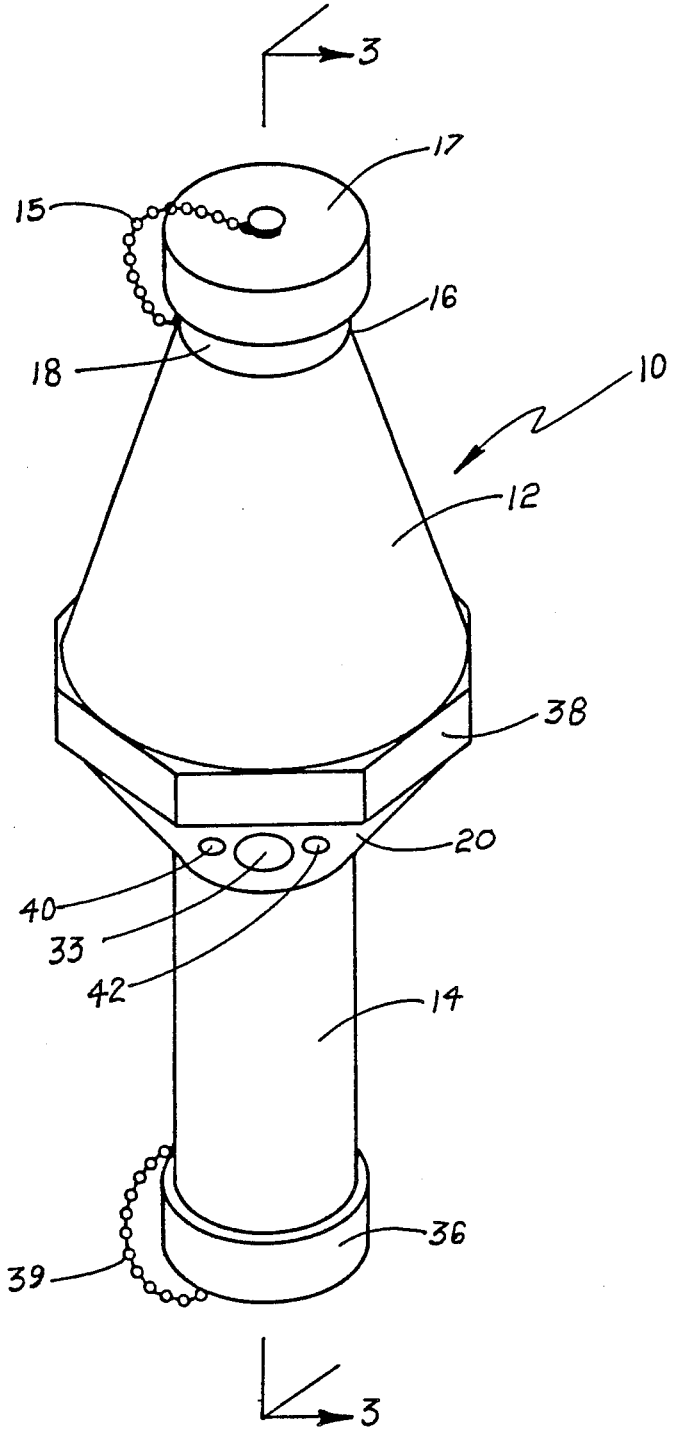
FIG. 1 is a perspective view of a presently preferred embodiment of the hand-held centrifuge apparatus of this invention.

The invention is best understood by reference to the drawings wherein like parts are designated with like numerals throughout.

General Discussion

Separation of particles from a suspending fluid is a technique fundamental to many areas of medicine and biotechnology. There is an increasing need to shorten the time necessary to effect such separation. For example, there are an increasing number of home tests that require red blood cell free plasma. Larger scale rapid separations are required for the processing of unit quantities of whole blood or the washing of glycerolized frozen blood. Numerous biotechnology applications arise including the removal of cells from a suspending growth medium.

The fundamental tool used to effect separation is the centrifuge, a device that creates acceleration by rotational motion. This acceleration acts on particles whose density is different than that of the suspending medium. The particles then move through the medium at a velocity dependent on the density difference, fluid viscosity, local acceleration and particle size.

Historically, the fluid suspension of particles is placed in an elongated, closed-end tube. The tube is mounted in a commercially available centrifuge apparatus which radially spins the tube in a plane perpendicular to the axis of rotation. The rotation rate for such a conventional device is in the thousands of revolutions per minute. The time required for sedimentation of the particles is an extended time, both the rate and time of rotation are a function of the nature of the suspension and the analytical protocol. Since the tubes are arrayed radially around the axis of rotation the devices tend to be rather large which, in turn, coupled with the high rotational speeds, means that the conventional centrifuge apparatus is usually quite expensive due to the requirement for precision machining to achieve the necessary balance, etc.

In an effort to reduce the dimensions of the centrifuge the angle of the tubes was changed with respect to the rotational axis. The tubes were placed at an acute angle to the rotational axis to reduce the diameter of the centrifuge head. Times of about one minute were obtained. Unexpectedly, shorter sedimentation times were obtained at relatively low rpm. The cells were packed in the microhematocrit tube in one minute and at about ⅓ the acceleration used in conventional centrifuges. Further, the packed cell volume (PCV) obtained in one minute is equivalent to the PCV obtained only after thirty minutes in the conventional centrifuge.

This innovation in centrifugation will allow the rapid separation of blood from plasma in microhematocrit tubes thus providing plasma for the myriad of blood tests. Further, because the separation is done at low speed, simple low cost centrifuges can be used. In fact, a small centrifuge has been constructed that uses an inexpensive motor powered by two dry cells and a simple plastic head.

Detailed Discussion

Spherical particle motion in a centrifuge tube can be described by equating drag force and buoyant force. Drag forces are described by Stoke's Law;

$$F_s = 6\pi\eta R\, v \qquad \text{Equation 1}$$

Where eta is the viscosity of the suspending fluid, R is the particle radius and v is the particle velocity in the direction of the acceleration.

The buoyant force on a particle is given by;

$$F_8 = \frac{4\pi R^3}{3} G(\rho_p - \rho_f) \qquad \text{Equation 2}$$

where G is the local acceleration, rho-p is the particle density and rho-f is the fluid density. The local acceleration is given by $G = w^2 r$, where w is the radian velocity and r is the distance between the particle and the axis of rotation. Since $v = dr/dt$ we can rearrange and integrate to obtain;

$$t = \frac{g}{2} \frac{\eta}{\omega^2 R^2 (\rho_p - \rho_f)} \ln \frac{\gamma_2}{\gamma_1} \qquad \text{Equation 3}$$

where r1 and r2 are distances from the axis of rotation between which the particle moves in time t (r2 is larger than r1). Note that the time of travel increases only logarithmically with distance because the local acceleration increases with r.

Figure 5:
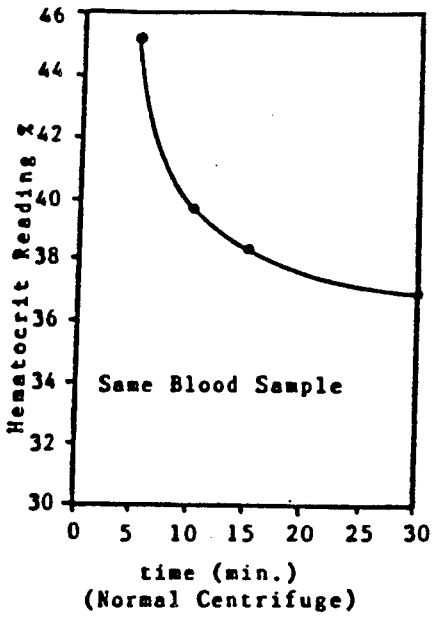
FIG. 5 is a comparison of the time required to obtain a hematocrit reading using a standard centrifuge apparatus.

Standard microhematocrit centrifuge has a disk-shaped head that rotates the axis of the hematocrit tubes normal to the axis of rotation of the head. Thus the blood cells must traverse half the length of the tube (assuming 50% PCV). For a typical microhematocrit tube this amounts to approximately 35,000 micrometers. FIG. 5 shows PCV as a function of time obtained from a standard microhematocrit centrifuge operating at 11,500 rpm. Note that equilibrium values are obtained only after times in excess of thirty minutes. Although Equation 1 predicts sedimentation times of the order of second for this angular velocity, blood cell-blood cell interactions, nonspheroidal blood cell shape and other hydrodynamic factors combine to produce these long real life sedimentation times.

Figure 6:
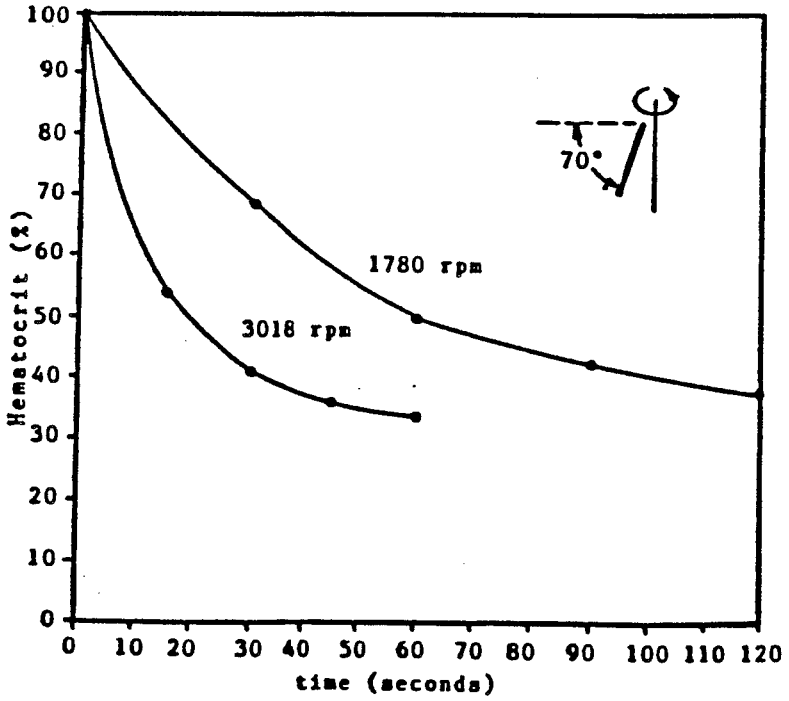
FIG. 6 is a demonstration of the relatively rapid hematocrit reading obtained using the apparatus and method of the present invention.

FIG. 6 shows the PCV fraction as a function of time obtained at lower rpm in tubes whose axis has been rotated 70 degrees from the plane normal to the rotational axis of the head. The radian velocity of the center of the tube has been reduced to 315 rad/s compared to 1200 rad/s in the standard centrifuge. Note, however, that equilibrium values are achieved at times of about one minute. Similar equilibrium values are obtained in two to three minutes at a radian velocity of 190 rad/s. Note also that the distance to the center of the tube from the axis of rotation is 3 cm in the angled tube head and 3.5 cm in the standard head so that the local acceleration on the particle is proportional to w in these experiments (the standard head should have a slight advantage).

Figure 7:
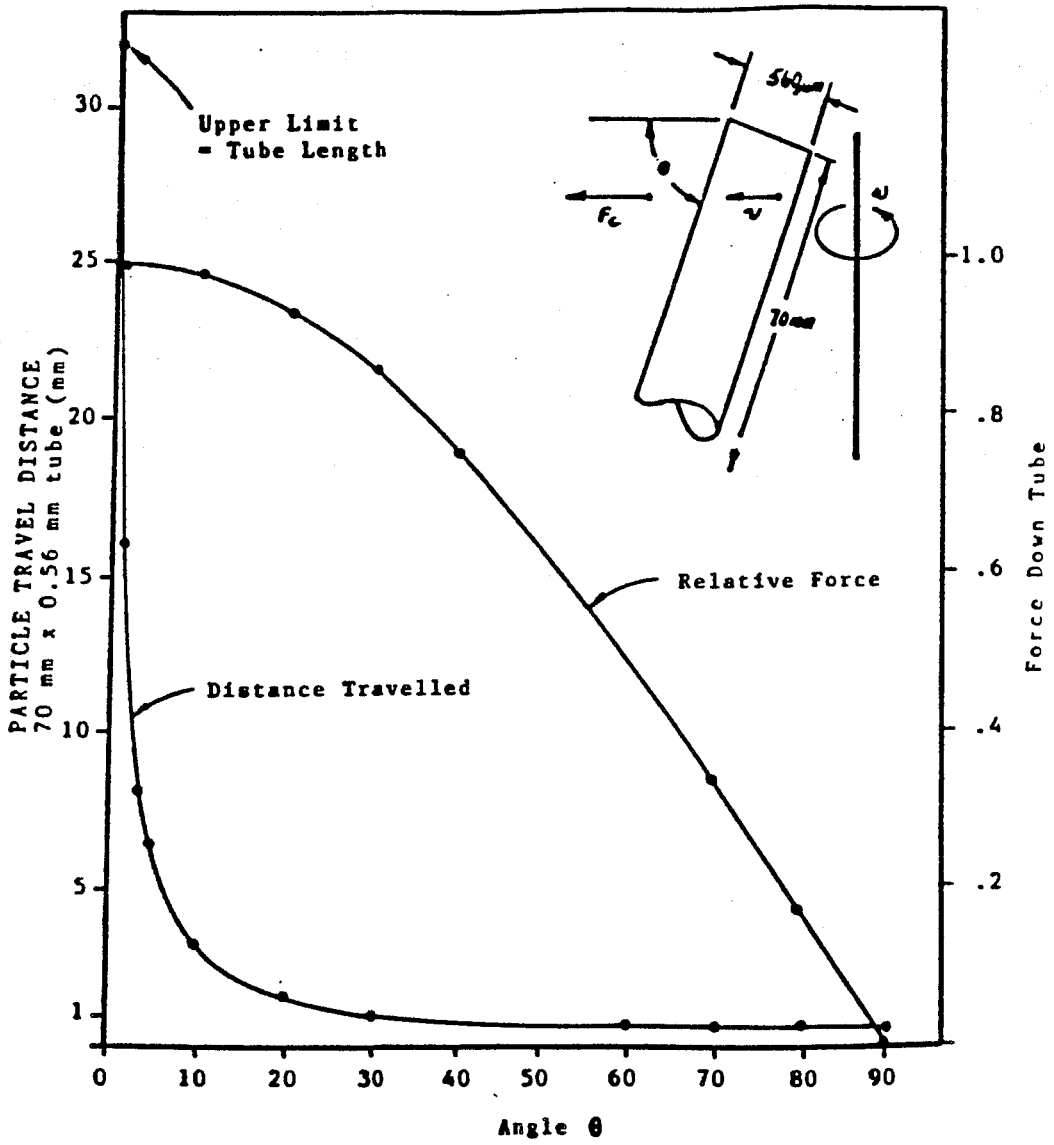
FIG. 7 is a comparison of particle travel distance in a hematocrit tube as a function of the angle between the axis of the hematocrit tube and a plane normal to the axis of rotation.

How can small accelerations sediment blood cells in less time? FIG. 7 diagrammatically illustrates the forces acting on cells in the angled head. For a tube whose axis is rotated parallel to the axis of head rotation, the maximum distance a cell can travel is the inside diameter of the tube. For a tube whose axis is rotated normal to the head rotation axis, the maximum distance a cell can travel is the length of the tube. The graph in FIG. 7 shows that for tubes at large angles from the normal to the rotation axis, the distance a cell may travel is close to the tube diameter (560 micrometers) and hence the sedimentation time is short. When the angle is small the distance is 35,000 um and the sedimentation time is longer.

Figure 8:
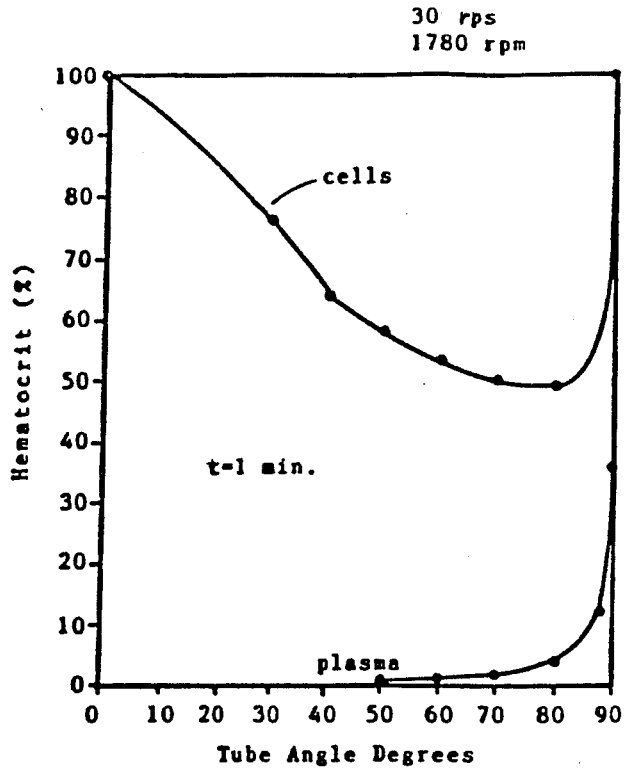
FIG. 8 is a comparison of the percent hematocrit and the angle of the hematocrit tube at a fixed time and speed of rotation.

If the angle is less than 90 degrees then there is a tangential force component acting to pull the packed cells down the length of the tube. The tangential force changes as the cosine of the angle being 0 to 90 degrees. FIG. 8 shows the one minute hematocrit, at 3000 rpm, as a function of tube angle. The bottom curve shows PCV fraction of cells remaining in the supernatant (actually the number of cells adhering to the tube wall in the upper portion of the tube). A tube angle of 70 degrees appears to be a good comprise between packing and adhering cells at 1780 rpm. Had this experiment been done at 3000 rpm a seventy degree hematocrit of 34% would have resulted (see FIG. 6). Note again that the feed hematocrit of 38 was obtained from a ten minute spin in the standard centrifuge and is larger than the 34% equilibrium value obtained from the 70 degree centrifugation.

Figure 9:
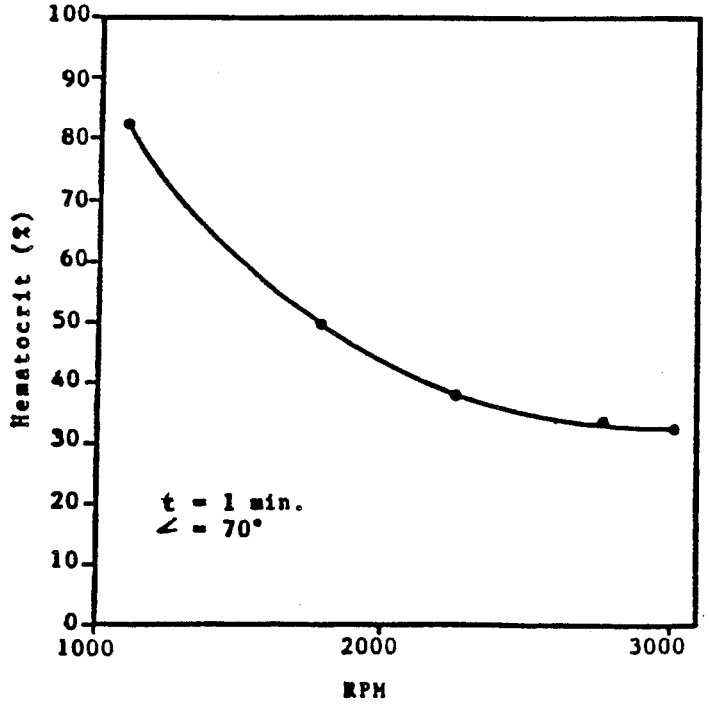
FIG. 9 is a comparison of the percent hematocrit reading as a function of rotation speed at a fixed angle.

FIG. 9 shows that for an angle of 70 degrees, 3000 rpm in this sized head produces almost equilibrium value hematocrits in one minute.

In the above documented experiments, cells (since they only had to travel short distances) were packed quickly at 70 degree tube angles. The aggregate slurry then moved down the tube length under the action of the tangential force. Sedimentation of the aggregate occurred quickly because of its larger (than a single cell) size.

Figure 2:
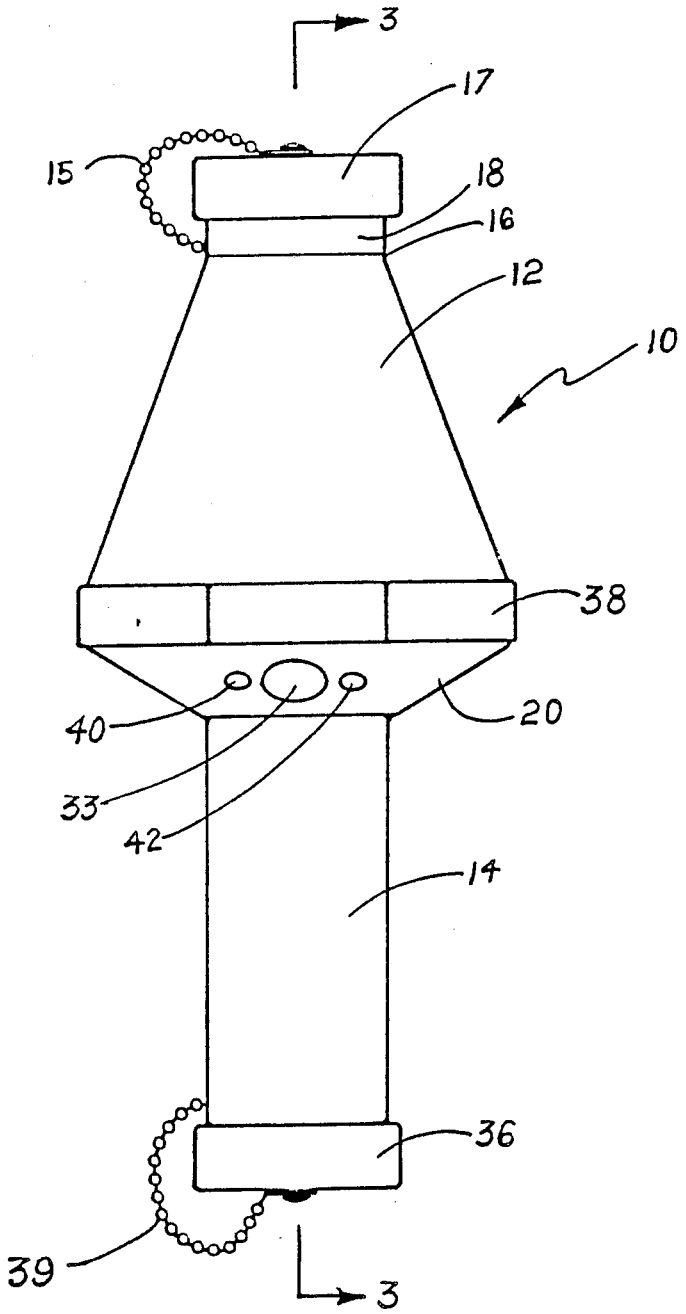
FIG. 2 is a frontal elevation of the hand-held centriguge.
Figure 3:
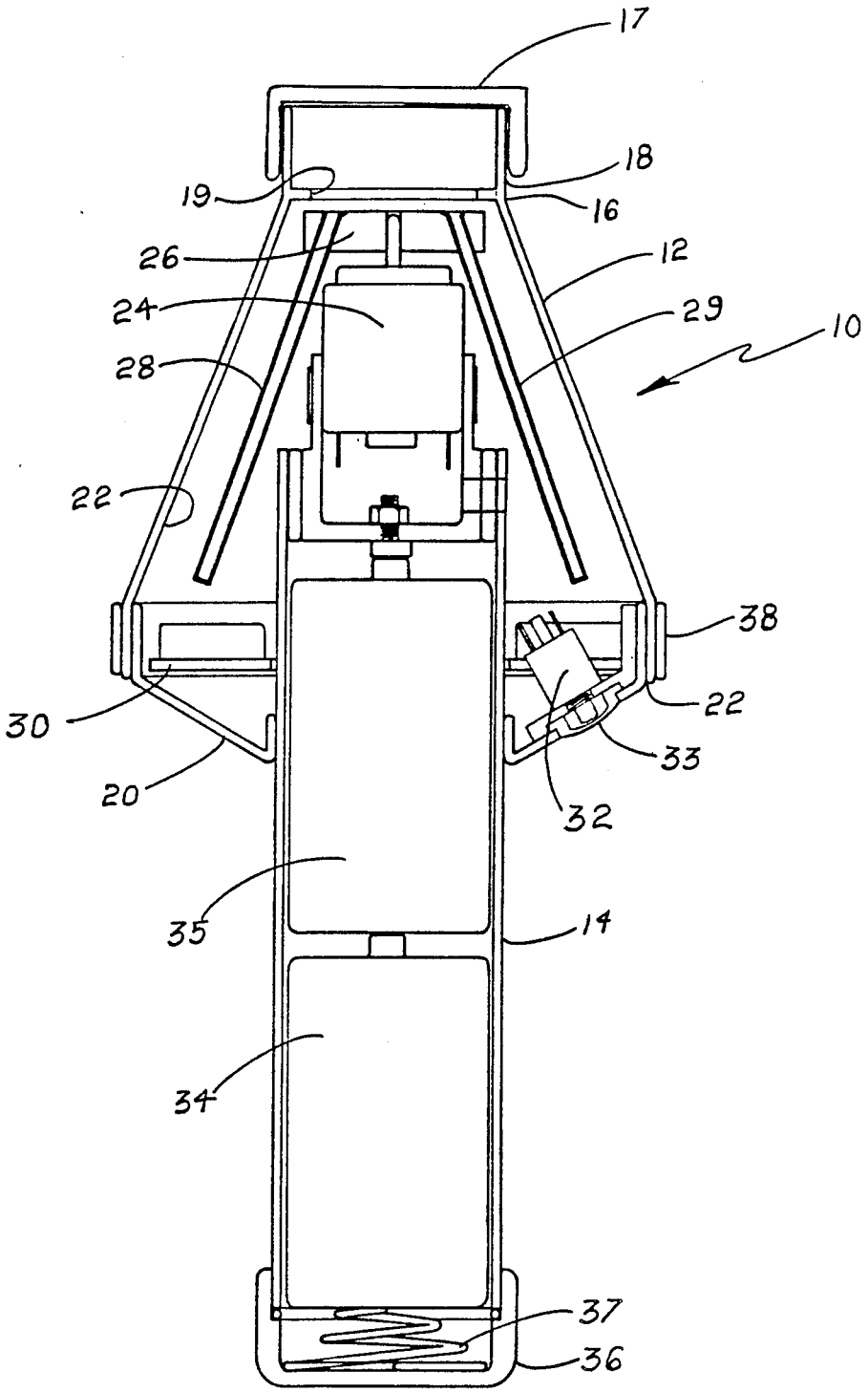
FIG. 3 is an enlarged cross sectional view taken along lines 3—3 in FIGS. 1 and 2.

Referring now to FIGS. 1–3, the novel, hand-held centrifuge apparatus of this invention is shown generally at 10 and includes a housing 12 and a handle 14. Housing 12 is fabricated with a frustoconical configuration having an upper end 16 terminating in an open, cylindrical neck 18 (closed by a cap 17) and a lower end joined to a mating, frustoconical base 20 along a joint 22.

With particular reference to FIG. 3 the space formed between housing 12 and base 20 provides an enclosure 22 for various components of this invention including, for example, motor 24, rotor 26, tube supports 28 and 29, circuit board 30 and switch 32. Access for placement and retrieval of hematocrit tubes (not shown) in tube supports 28 and 29 is provided through a throat 19 adjacent the base of neck 18. Each of tube supports 28 and 29 are removable from rotor 26 to facilitate cleaning, etc., of the particular tube support.

Motor 24 and switch 32 (actuated upon pressing button 33) are commercially available components compatible for operation with two conventional, D-cell batteries 34 and 35. Handle 14 serves as the receiving chamber for batteries 34 and 35 as well as providing the necessary hand gripping surface for hand-held centrifuge 10. A cap 36 provides access to batteries 34 and 35 inside handle 14 while a spring 37 inside a cap 36 assures appropriate electrical contact for batteries 34 and 35.

A faceted buttress 38 (FIG. 1) formed around joint 22 provides a plurality of facets upon which hand-held centrifuge 10 can be rested to preclude inadvertently rolling of hand-held centrifuge 10. A tether 15 secures cap 17 to neck 18 while a tether 39 secures cap 36 to handle 14, both of tethers 15 and 39 preventing the inadvertent loss or misplacement of the respective caps 17 and 36.

Signal lights 40 and 42 provide the desired visual indication to the operator (not shown) of the condition of hand-held centrifuge 10. For example, signal light 40 is a red light that is illuminated when the circuitry (see FIG. 4) determines that hand-held centrifuge is in an inoperative condition such as low battery, etc. Signal light 42 is a green light and is illuminated when hand-held centrifuge 10 is operating.

Figure 4:
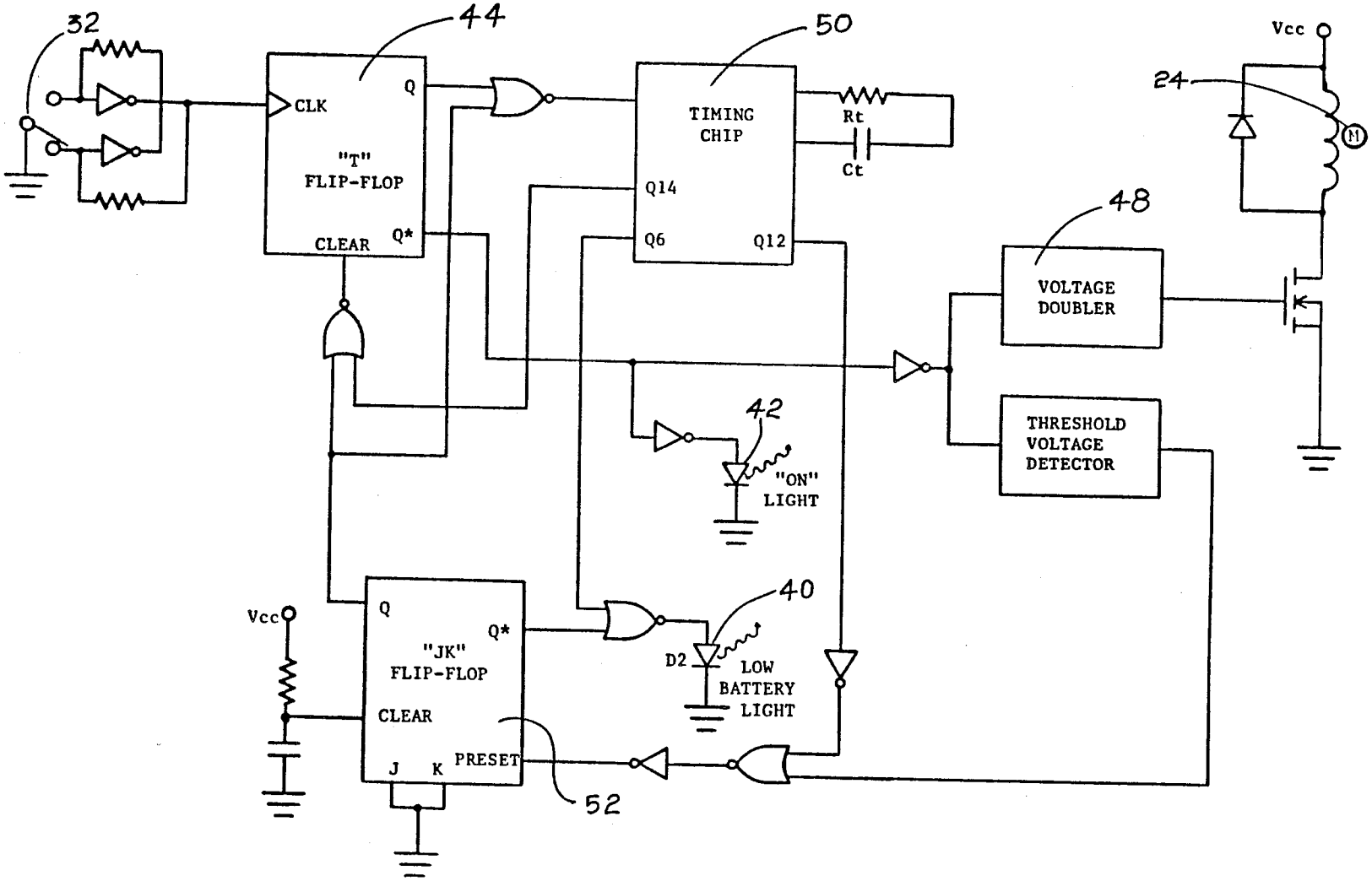
FIG. 4 is a schematic of the circuit diagram for the novel circuitry of this invention.

Referring now to FIG. 4, a schematic of the circuitry for circuit board 30 (FIG. 3) is shown and includes switch 32 and supporting circuitry to implement single button operation. The button 33 (FIGS. 1–3) of switch 32 is debounced and connected to the clock input of a "T" flip flop 44. The Q* output of flip flop 44 controls the gate voltage of a MOSFET transistor 46. This MOSFET 46, when turned on, provides a current path through the DC motor 24 while dropping very little voltage itself. Since the MOSFET gate to source threshold voltage requires greater than about five volts for proper operation, the circuit employs a voltage doubler 48 to boost the gate voltage so a three volt battery can be employed.

A timing chip 50 provides three signals: the Q14, Q12 and Q6 outputs. A pulse on Q14 signals the end of the centrifugation run, and at set intervals during the run the Q12 output enables the voltage test circuitry. If the battery voltage drops and the run is aborted, the Q6 output causes the D2 LED (signal light 40) to flash. The functioning of these outputs is discussed below.

The Q14 output of timing chip 50 is connected to the clear input of the "T" flip flop 44 and ends the centrifugation run by bringing this input low. The time interval before Q14 is asserted and is set by the RC time constant of $R_t \times C_t$.

The Q12 output of timing chip 50 enables the voltage test circuitry into the present input of the JK flip flop 52 at set times during the centrifugation run. If the battery voltage drops to a point where the rotor speed is inadequate, the threshold voltage detector will output a low signal. This signal is masked out until the Q12 output is also asserted. This feature allows the battery voltage to drop temporarily during motor acceleration without aborting the run.

If the battery voltage is too low during a Q12 pulse, then the JK flip flop 52 is clocked so that $Q_{JK}$ output "clears" the "T" flip flop 44 and so deactivates motor 24, voltage doubling circuitry 48, and threshold voltage detection circuitry. The JK flip flop 52 Q output also overrides the "T" flip flop 44 deactivation of timing chip 50 and maintains this chip's operation. The JK flip flop 52 Q* output enables the timing chip 50 Q6 output into the D2 LED 42, causing it to flash, signalling a low battery aborted run. Once the low battery LED 40 begins flashing, the pushbutton has no effect and the D2 LED 40 will flash indefinitely until the batteries are removed and replaced. This feature prevents operation of the system if the batteries and rotor speed are substandard.

Pushing the on/off button while the motor is on will clock the "T" flip flop 44 and terminate the run.

Figure 10:
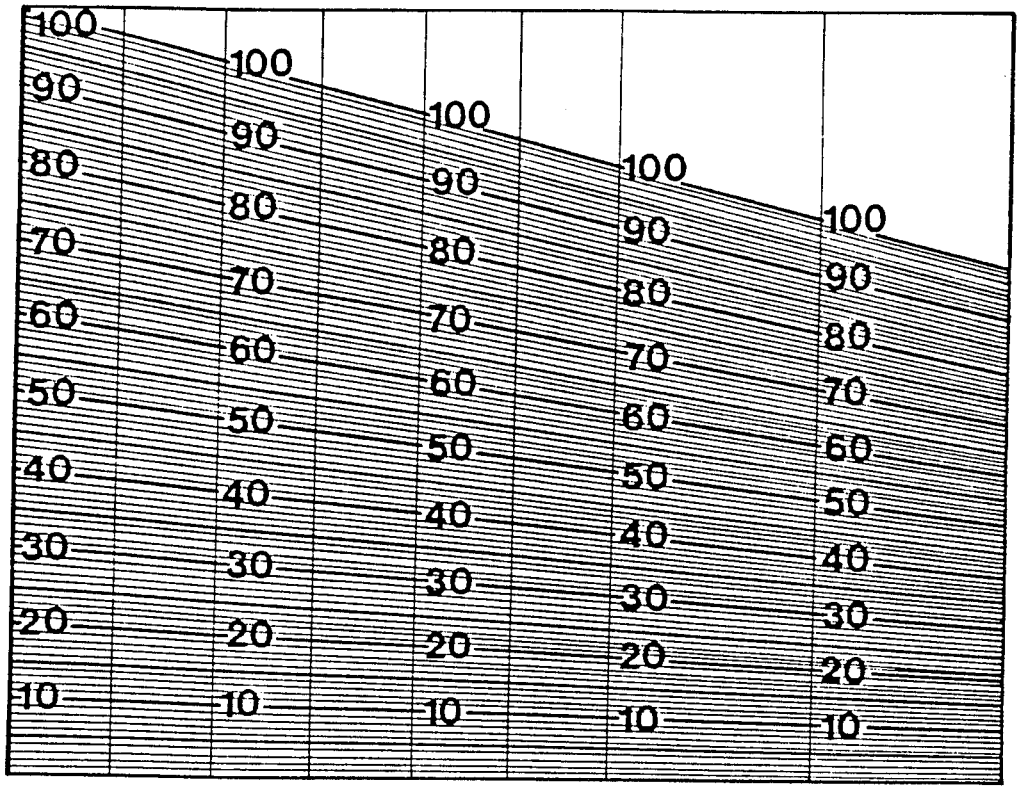
FIG. 10 is an enlargement of the chart against which the sample tube is placed to obtain a reading of the hematocrit of the particular blood sample.

Referring now to FIG. 10, an enlargement of the chart for obtaining a hematocrit reading is shown. This chart is selectively reduced and wrapped around handle 14 (FIGS. 1–3) so as to present the chart in an easily accessible configuration.

In operation, a blood sample is drawn into a conventional hematocrit tube (not shown) according to customary procedures and the tube is then inserted into a tube holder 28 or 29 (FIG. 3). Cap 17 is placed over neck 18 and button 33 is depressed to activate the circuitry and cycle light 42 of the electronic circuit shown in FIG. 4. Upon completion of the centrifuge cycle light 42 (FIGS. 1 and 2) is extinguished and rotor 26 stops turning. Cap 17 is then removed and the sample tube is retrieved and placed against a reduced version of the chart of FIG. 10.

Since each hematocrit tube will be filled to a different level the chart is prepared with a sloping line indicating 100% or the total volume of the sample. Thus, the upper and lower limits of the sample are aligned with the 100% and bottom lines, respectively, of the chart so that the line representing the volume of sediment in the tube can be read directly from the chart.

Accordingly, a rapid, accurate hematocrit reading is obtained according to the practice of this invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A hand-held centrifuge apparatus comprising:

a housing;

a handle mounted to said housing, said handle comprising a receptacle for at least one battery;

an electric motor inside said housing;

a rotor rotatably mounted on said motor and rotatable inside said housing, said rotor including at least one holder for a sample tube; said holder being mounted at an acute angle to the axis of rotation of said rotor;

battery means to drive said electric motor;

electronic circuit means for controlling the operation of said electric motor, said electronic circuit means including voltage test means to test the voltage in the electronic circuit to determine if adequate voltage is being supplied by said battery means across said electric motor if said voltage test means detects inadequate voltage.

2. The hand-held centrifuge apparatus defined in claim 1 wherein said electronic circuit means comprises signal means for signalling when said deactivation means has deactivated said electric motor.

3. The hand-held centrifuge apparatus defined in claim 1 wherein said electronic circuit means comprises disabling means for disabling said electronic circuit when said deactivation means has deactivated said electric motor, said disabling means maintaining said electronic circuit in a disabled state until adequate voltage is supplied by said battery means.

4. The hand-held centrifuge apparatus defined in claim 3 wherein said disabling means includes masking means for masking said disabling means during acceleration of said electric motor thereby precluding inadvertent deactivation of said electric motor when said rotor speed is inadequate during said acceleration.

5. The hand-held centrifuge apparatus defined in claim 1 wherein said electronic circuit means comprises a timing means, said timing means cooperating with said voltage test means to drive said electric motor for a predetermined time at a preselected voltage thereby assuring that a sample tube held in said holder on said rotor has been subjected to a predetermined centrifugal force.

6. The hand-held centrifuge apparatus defined in claim 1 wherein said electronic circuit means comprises a voltage doubler means for boosting gate voltage to a MOSFET in said electronic circuit means thereby permitting the use of a lower voltage battery means.

7. A hand-held centrifuge apparatus comprising:

a housing;

a handle mounted to said housing, said handle comprising a receptacle for at least one battery;

an electric motor inside said housing;

a rotor rotatably mounted on said motor and rotatable inside said housing, said rotor including at least one holder for a sample tube; said holder being mounted at an acute angle to the axis of rotation of said rotor;

battery means to drive said electric motor;

electronic circuit means for controlling the operation of said electric motor, said electronic circuit means including voltage test means to test the voltage in the electronic circuit to determine if adequate voltage is being supplied by said battery means across said electric motor if said voltage test means detects inadequate voltage;

disabling means for disabling said electronic circuit when said deactivation means has deactivated said electric motor, said disabling means maintaining said electronic circuit in a disabled state until adequate voltage is supplied by said battery means.

8. The hand-held centrifuge apparatus defined in claim 7 wherein said electronic circuit means comprises signal means for signalling when said deactivation means has deactivated said electric motor.

9. The hand-held centrifuge apparatus defined in claim 7 wherein said disabling means includes masking means for masking said disabling means during acceleration of said electric motor thereby precluding inadvertent deactivation of said electric motor when said rotor speed is inadequate during said acceleration.

10. The hand-held centrifuge apparatus defined in claim 7 wherein said electronic circuit means comprises a timing means, said timing means cooperating with said voltage test means to drive said electric motor for a predetermined time at a preselected voltage thereby assuring that a sample tube held in said holder on said rotor has been subjected to a predetermined centrifugal force.

11. The hand-held centrifuge apparatus defined in claim 7 wherein said electronic circuit means comprises a voltage doubler means for boosting gate voltage to a MOSFET in said electronic circuit means thereby permitting the use of a lower voltage battery means.

12. A method for subjecting a sample of a fluid suspension to a predetermined centrifugation force at a location remote from a source of electrical power comprising:

preparing a hand-held centrifuge apparatus including a housing, a handle mounted to said housing, said handle forming a receptacle for at least one battery, a battery, an electrical motor inside said housing with a rotor and sample tube holder mounted to said electric motor, said sample tube holder being mounted at an acute angle to the axis of rotation of said rotor;

controlling the operation of said electric motor with an electronic circuit means, said electronic circuit means comprising voltage test means for testing voltage in said electronic circuit, deactivation means for deactivating said electric motor if said voltage is below a preselected value, and disabling means for disabling said electronic circuit means until adequate voltage is supplied to said electronic circuit means.

13. The method defined in claim 12 wherein said controlling step includes providing a signalling means for signalling when said disabling means is operating.

14. The method defined in claim 12 wherein said controlling step includes incorporating a timing means in said electronic circuit means, said timing means cooperating with said voltage test means for driving said electric motor for a predetermined time at a preselected voltage thereby assuring that a sample tube held in said sample tube holder is being subjected to a predetermined centrifugal force.

15. The method defined in claim 12 wherein said controlling step includes boosting a gate voltage to a MOSFET as a voltage doubler means in said electronic circuit means thereby permitting using a lower voltage battery.

16. The method defined in claim 12 wherein said controlling step includes masking said disabling means during acceleration of said electric motor thereby precluding deactivating said electric motor during said acceleration.

* * * * *